United States Patent [19]

Dineen

[11] 4,352,269

[45] Oct. 5, 1982

[54] STIRLING ENGINE COMBUSTOR

[75] Inventor: John J. Dineen, Durham, N.H.

[73] Assignee: Mechanical Technology Incorporated, Latham, N.Y.

[21] Appl. No.: 172,372

[22] Filed: Jul. 25, 1980

[51] Int. Cl.[3] ..... F02G 1/04

[52] U.S. Cl. ..... 60/517; 431/172; 431/215

[58] Field of Search ..... 60/517, 524, 526; 431/172, 215

[56] References Cited

U.S. PATENT DOCUMENTS

| | | | |
|---|---|---|---|
| 3,015,475 | 1/1962 | Meijer et al. | 60/517 X |
| 4,069,671 | 1/1978 | Berntell | 60/526 X |
| 4,077,215 | 3/1978 | Reams et al. | 60/517 |
| 4,277,942 | 7/1981 | Egnell et al. | 60/517 |

*Primary Examiner*—Allen M. Ostrager

*Assistant Examiner*—Stephen F. Husar

*Attorney, Agent, or Firm*—Joseph V. Claeys; Arthur N. Trausch, III

[57] ABSTRACT

A gaseous fuel combustor for a Stirling engine includes a shell mounted on the engine, and air inlet and exhaust ports formed in the shell. An annular cylindrical recuperator communicates with the inlet and exhaust ports for preheating the combustion air with the heat from the exhaust. An annular burner surrounds the dome shaped engine heater head for mixing gaseous fuel with the air and burning it at the outer peripheral edge of the heater head. The combustion products converge upwardly in a narrow space between a ceramic partition and the heater head dome so that the heat flux is constant. The combustion products exhaust through a axial hole in the center of the ceramic partition and travel back outward over the top of the partition to the annular recuperator.

10 Claims, 7 Drawing Figures

Fig. 5
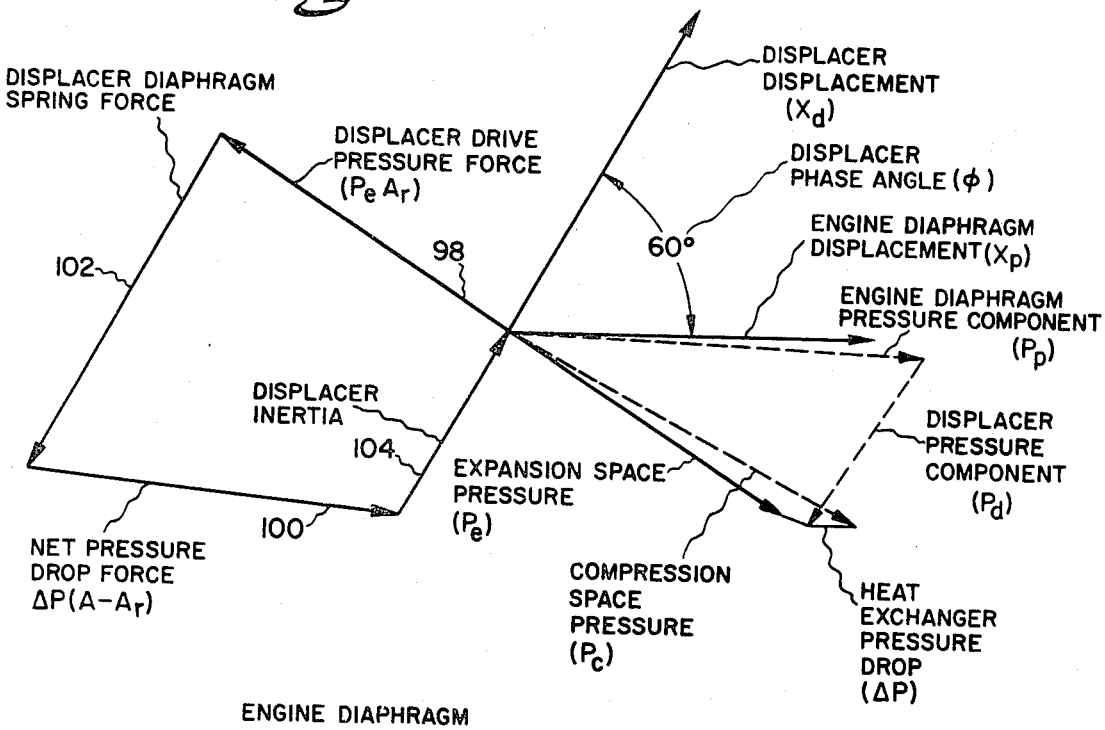
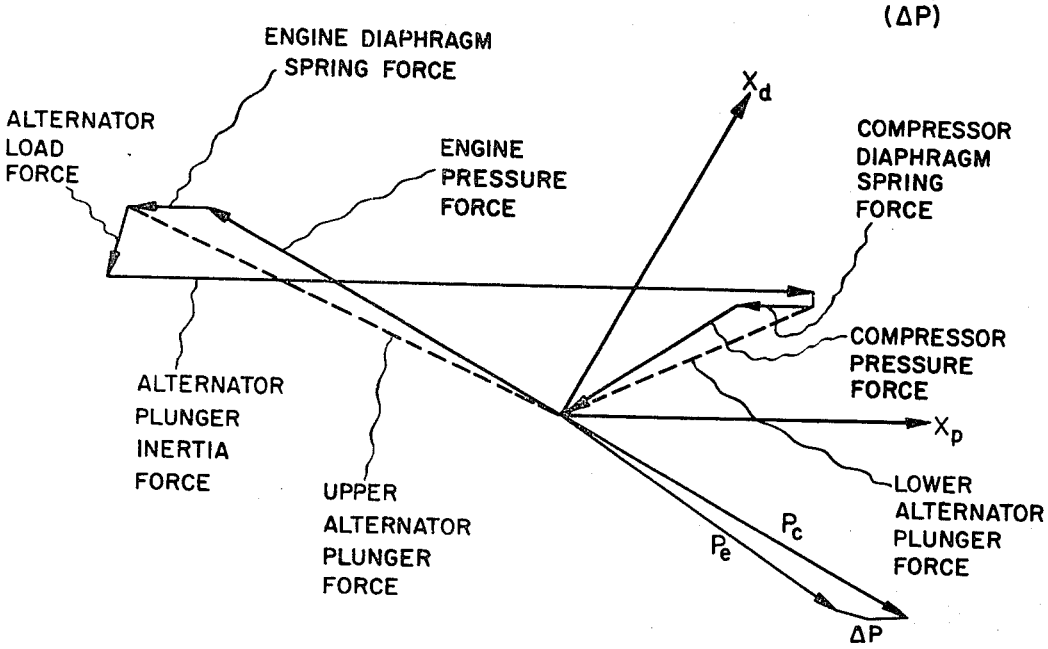
Fig. 6

STIRLING ENGINE COMBUSTOR

BACKGROUND OF THE INVENTION

This invention relates to hermetically sealed heat engine powered devices, and more particularly to a free-piston Stirling engine driven alternator/compressor contained entirely within a single hermetically sealed casing. This invention is related to U.S. patent application Ser. Nos. 168,714 and 168,075 filed July 14, 1980, and the disclosures thereof are incorporated by reference herein.

The high theoretical efficiency of the Stirling engine has attracted considerable interest in the era of increasing fuel cost and decreasing fuel supplies. The omnivorous external combustor of the closed cycle Stirling engine adds the additional advantages of easy control of combustion emissions, use of safer, cheaper, and more readily available fuels, and quiet running operation, all of which combine to make the Stirling engine a highly desirable alternative to the internal combustion engine.

Despite these known advantages, development of the Stirling engine has proceeded at a much slower rate than would be expected. Certain of the problems that have been encountered are of such extreme difficulty as to cause resourceful and sophisticated organizations to abandon altogether the development of the Stirling engine. Some of the most intractable problems are the need to seal the working gas at high pressure within the working space, the requirement for transferring heat at high temperature from the heat source to the working gas through the heater head, and a simple, reliable and inexpensive means for modulating the power as the load changes.

One fruitful approach to the solution of these problems which is suitable for a certain range of applications is the free-piston Stirling engine. The free-piston Stirling engine uses a displacer which is mechanically independent of the power output member. Its motion and phasing relative to the power output member is accomplished by the state of a balanced dynamic system of springs and masses, rather than a mechanical linkage.

One technique for phasing the displacer and providing motive power to maintain the oscillating movement of the displacer to supply the energy dissipated by the displacer in shifting working fluid during the Stirling cycle is the use of a gas spring between the displacer and the power output member. This is a convenient means for maintaining the oscillating movement of the displacer but it produces an undesirable power coupling between the power output member and the displacer and it necessitates the use of undesirable close manufacturing tolerances in the area of the gas spring. In addition, the inherent hysteresis losses in a gas spring, representing an undesirable power loss, are magnified in such an arrangement.

One major advantage of the free-piston Stirling engine is its adaptability to hermetic sealing. This eliminates or simplifies many of the sealing problems and simplifies the mechanical design, resulting in a potential savings in fabrication cost and reduction of friction losses. It also offers the potential advantage of long-term, maintenance-free operation. However, in order to achieve this potential, the components having inherent short-term durability, such as those incorporating seals and sliding wear surfaces, must be strengthened or eliminated by redesign.

SUMMARY OF THE INVENTION

Accordingly, it is an object of this invention to provide a Stirling engine providing improved solutions to the above problems. The object of the invention is achieved in a Stirling engine including a vessel containing a working space which includes a hot chamber, a cold chamber, and a displacer which oscillates in the working space between the hot and cold chambers for cycling working fluid between them. The displacer includes a unitary device for reducing the effective area of one end relative to the other end for storing energy upon deflection into the one end to drive the displacer toward the other end.

The engine drives an output member which includes an alternator armature which, in addition, acts as a seismic mass to power a gas compressor. A gas pressure proportion system is provided to maintain the proportional relationship between the mean pressure of the gas in the compressor and the mean pressure of the working gas in the Stirling engine.

The engine of this invention does not employ sliding seals and therefore the close manufacturing tolerances necessary for use with such seals is eliminated with a consequent saving of cost, maintenance effort, lubrication, wear, and all the other problems incident to the use of sliding seals.

This invention provides a Stirling engine in which undesirable power transfer between the displacer and the power output member is eliminated. Heat losses and manufacturing costs may be reduced by lowering the mean pressure of the working gas so that the walls of the vessel can be made thinner.

The engine is designed to operate at a frequency of 60 hertz so that the linear alternator may be driven at the engine frequency. The short stroke of the engine at the 60 hertz frequency is amplified by a hydraulic/mass system to provide a suitable stroke to the alternator armature and the coupled compressor.

More particularly, this invention concerns a gaseous fuel combustor for a Stirling engine including a shell mounted on the engine, and air inlet and exhaust ports formed in the shell. An annular cylindrical recuperator communicates with the inlet and exhaust ports for preheating the combustion air with the heat from the exhaust. An annular burner surrounds the dome shaped engine heater head for mixing gaseous fuel with the air and burning it at the outer peripheral edge of the heater head. The combustion products converge upwardly in a narrow space between a ceramic partition and the heater head dome so that the heat flux is constant. The combustion products exhaust through an axial hole in the center of the ceramic partition and travel back outward over the top of the partition to the annular recuperator.

DESCRIPTION OF THE DRAWINGS

The invention and its many attendant objects and advantages will become more clear upon reading the following description of the preferred embodiment in conjunction with the appended drawings, wherein:

FIG. 5 is a displacement and force phasor diagram for the engine components in the embodiment of FIG. 1;

FIG. 6 is a force phasor diagram for the power section of the embodiment shown in FIG. 1.

DESCRIPTION OF THE PREFERRED EMBODIMENT

Figure 1:
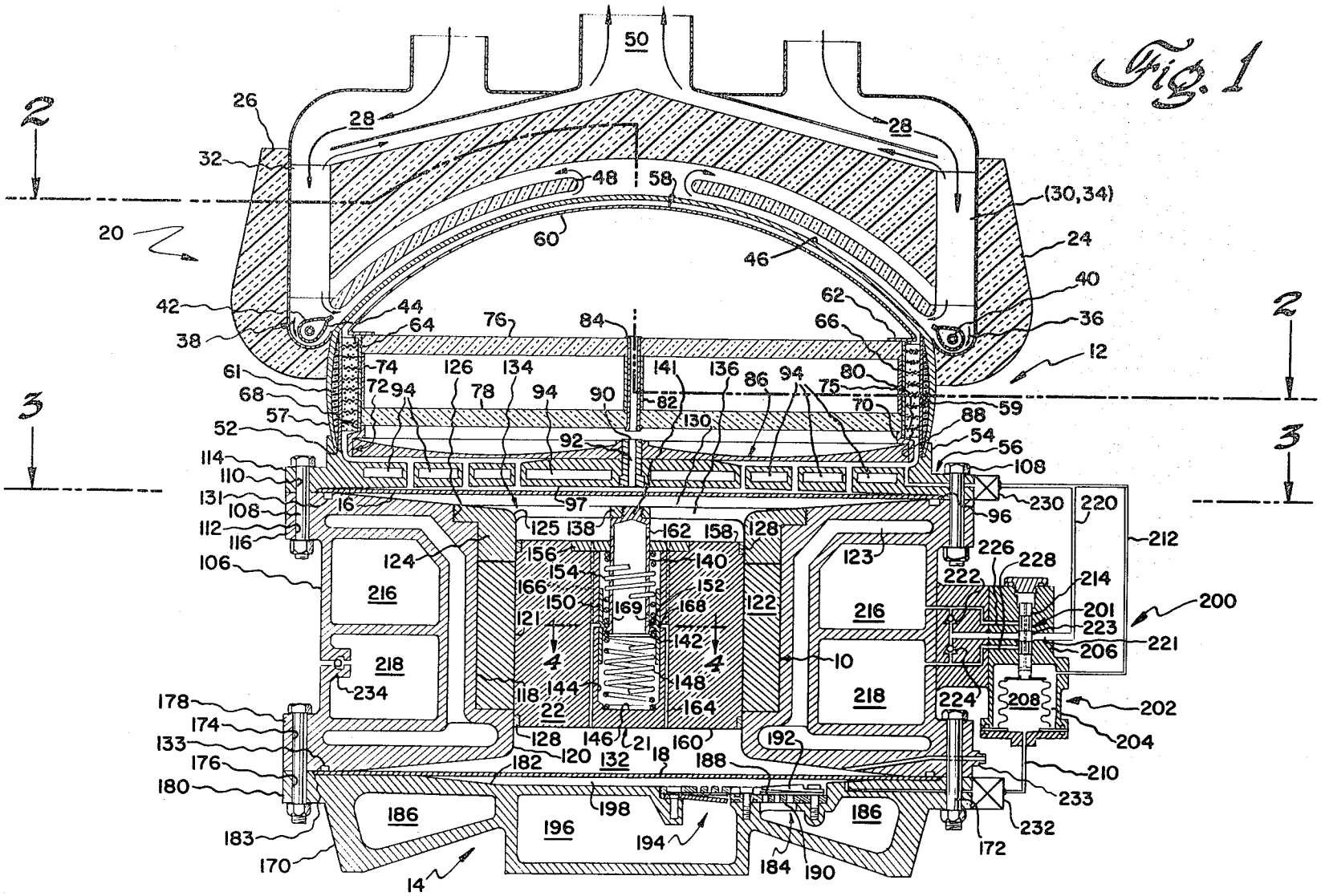
FIG. 1 is a sectional elevation of a diaphragm Stirling engine compressor/generator made in accordance with this invention.

Referring now to the drawings wherein like reference characters designate identical or corresponding parts, and more particularly to FIG. 1 thereof, a diaphragm Stirling engine compressor/generator is shown having an alternator 10 mounted between a diaphragm Stirling engine 12 and a compressor 14, all within a hermetically sealed vessel. The junction of the engine 12 and the alternator 10 is at an engine diaphragm 16, and the junction between the alternator 10 and the compressor 14 is a compressor diaphragm 18. The portion of the apparatus above the engine diaphragm is denoted "the engine" and the portion below the engine diaphragm is denoted "the power section."

The machine is attitude insensitive and can in fact operate in any position. It will be described as illustrated in FIG. 1, with a burner or heater 20 at the "top" and the compressor 14 at the "bottom." It will be understood, however, that these terms are used merely for convenience and are not to be given any limiting effect.

Energy enters the system through the burner 20 mounted on the top of the engine 12. The heat energy from the burner is converted to a pressure wave in the engine 12 which is transmitted through the engine diaphragm 16 to a power piston 21 incorporating a hollow armature 22 of the linear alternator 10. The pressure wave causes the power piston 21 to oscillate axially generating an electrical power output. The kinetic energy of the power piston 21 is also partially absorbed by the compressor diaphragm 18 which flexes and compresses the gas in the compressor 14.

Figure 2:
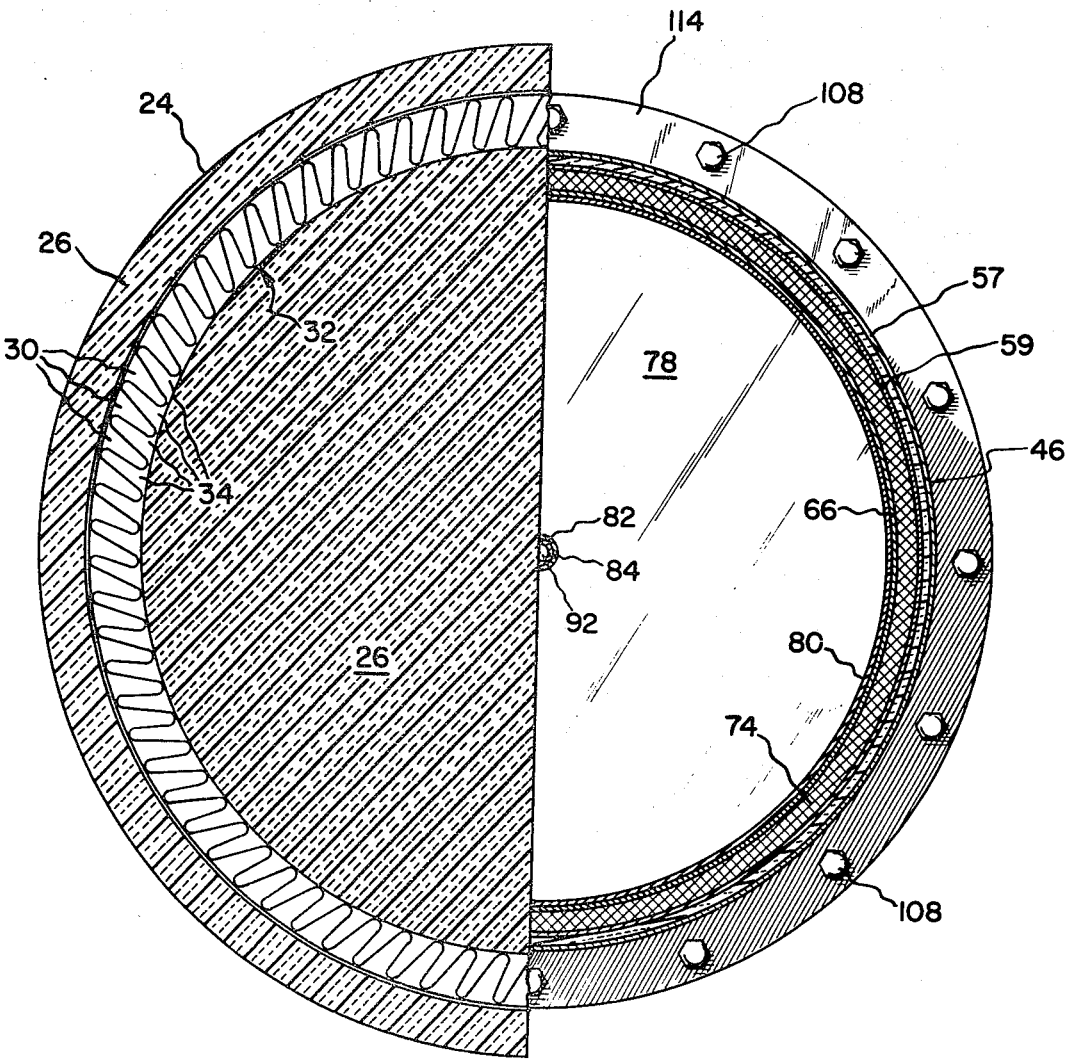
FIG. 2 is a sectional elevation along lines 2—2 in FIG. 1.

The heater 20 includes an outer shell 24 surrounding a layer of insulation 26 to prevent heat loss from the heater to the atmosphere. Air enters the heater through an air intake 28 and passes downwardly through the intake channels 30 of an involute heat recuperator 32 shown most clearly in FIG. 2 where the intake air is heated by heat exchangers from hot exhaust gases passing through the exhaust channels 34 of the recuperator 32. The involute form provides a large surface area and equal cross-sectional flow areas for the intake and exhaust channels for optimum heat transfer. The hot intake air then enters a combustion chamber 36 which includes an annular burner ring 38. The burner ring 38 has an annular pipe 40 which is perforated in a regular pattern around its entire surface to insure uniform distribution of the gas in the space between the pipe 40 and a surrounding burner sleeve 42. A series of burner jets 44 project inwardly from the sleeve 42 for directing jets of natural gas, which mix with the incoming heated air to produce jets of flame, at the top outer periphery of the top of the hermetic vessel which is a heater head 46.

The flame can be diffusion flame or a partial or complete premix flame. Depending on the cross-sectional gas flow area, the quenching surface area, and the air flow speed, it may be desirable to position the burner tube slightly farther upstream in the air flow path to provide a large residence time for mixing and ignition. The dimensioning of the gas flow cross-sectional areas is designed so that the air speed is not greater than the flame speed to ensure flame stability.

The hot combustion products flow upwardly and radially inward over the dome-shaped heater head 46, held in close heat transfer relationship to the heater head by a ceramic partition 48 which lies closely over the heater head 46. The cross-sectional flow area over the entire gas flow path is approximately equal. This equality is achieved by use of external radial fins on the heater head which exhaust upward into contact with the partition 48, and by the spacing between the partition and the heater head along the flow path. The combustion products then pass through a central opening in the partition 48 and downward and radially outward over the partition 48 and pass upwardly out through the exhaust channels 34 of the heat recuperator 32 and thence upwardly through the exhaust pipe 50.

The burner flame is distributed around the heater head 46 in a ring at its outer periphery so that the heat at the highest temperature is distributed over the widest possible flow area. As the combustion products, cooled somewhat from initial contact, flow upwardly and inwardly over the surface of the heater head, the area of the central portion of the heater head and the combustion gas temperature decrease correspondingly, so the heat transfer per unit area over the entire heater head is fairly uniform. In this way, the entire surface of the heater head is held close to its designed temperature uniformly.

The heater head 46 is a dome- or inverted dish-shaped member formed of heat-resistant material such as Inconel X750. At its lower free end or lip 52, the heater head is fastened as by welding to the inside of an upstanding flange 54 of a base member 56 which constitutes part of the hermetic vessel.

The depending skirt 57 of the heater head 46 is bowed outwardly to provide an insulating space. The space is defined between the inside wall of the skirt 57 and the outside wall of a cylindrical collar 59 fastened at its top and bottom edges to the top portion and lower lip 52 of the skirt 57, respectively. The insulating space is filled with a suitable high-temperature insulation 61 such as asbestos or ceramic.

A displacer 58 is mounted within the heater head 46 for axial oscillation therein. The displacer 58 includes a dome-shaped top member 60 having an inwardly extending bottom flange 62 which is fastened to a top flange 64 of an upright sleeve 66. The lower edge 68 of the sleeve 66 is fastened to an upstanding lip 70 of a strong and rigid ferrule 72.

An annular regenerator 74 is disposed in the cylindrical space defined between the bottom flange 62 of the dome-shaped top member 60 and a central step portion 75 of the ferrule 72, and between the outer surface of the sleeve 66 and the inner surface of the cylindrical collar 59. The regenerator 74 is a mass of fine wires made of material having high heat capacity and heat resistance such as Inconel, capable of storing significant amounts of heat but presenting a very small resistance to the flow of working gas around and between the wires.

A pair of annular discs 76 and 78 are held between the underside of the flange 62 and the top surface of the lip 70 of the ferrule 72, and are held apart by an outer spacer sleeve 80 and an inner concentric spacer sleeve 82. The discs 76 and 78 are formed of ceramic material and are for the purpose of adding mass to the displacer member to optimize the dynamics of the system, as will be explained in detail below, and also to provide insulation between the hot top end of the displacer 58 and the cold bottom end. Each of the discs 76 and 78 has an axial hole formed therethrough which receives a hollow rivet 84. The rivet 84 is crimped over at its top and bottom ends to hold the discs 76 and 78 rigidly against the inner spacer sleeve 82 to rigidify the structure, and also to provide a capillary fluid passage between the space below the displacer hot end and the space above the displacer cold end to provide for fluid pressure equalization throughout the displacer.

The bottom face of the displacer 58 is sealed with a displacer diaphragm 86. the displacer diaphragm 86 is designed to spring the displacer to ground and therefore is formed of fine spring steel and is shaped to act as a spring. The displacer diaphragm functions to support and center the displacer within the working space defined by the dome-shaped heater head 46 and the top of the base member 56, and also to store energy upon axial displacement of the displacer member from the center position, to act as a restoring force to return the displacer member in the direction from which it was displaced. The displacer diaphragm 86 is fastened at its outer periphery to a depending flange 88 of the ferrule 72 and to an upstanding axial post 90 fastened to the center of the base member 56. In this way, the displacer 58 is sprung to the base member 56 at the center and is thereby radially supported within the working chamber out of contact with the chamber walls. The freedom from frictional contact with the chamber walls eliminates the frictional losses usually attendant such rubbing contact and also eliminates wear products which could otherwise contaminates the regenerator 74 and the passages for working fluid within the system.

A fine fluid passage 92 is formed in the axial post 90 to equalize the pressure within the displacer member with the mean pressure of the working gas in the working space.

A series of coolant passages 94 is formed in the base member 56 for receiving a circulating coolant for the purpose of cooling the lower end of the engine. The coolant is circulated through these passages and is then passed through an external heat exchanger to reject heat to the atmosphere. Any suitable coolant could be used such as water, although the preferred coolant is liquid Freon in heat pump applications because the system includes a Freon condensor for other purposes which can also be used to cool the Freon from the cooling passages 94.

The engine diaphragm 16 is welded at 96 to the bottom face of the base member 56. The diaphragm 16 is designed to deflect approximately 0.50 inches and therefore a concave support surface 97 is formed on the bottom face of the base member 56 to limit the upward deflection of the diaphragm. The downward deflection of the diaphragm 16 beyond its limit is prevented by a hydraulic system to be described more fully below.

The base 56 of the engine 12 is affixed to the top of the central portion of the hermetic vessel which is in the form of a cylindrical body member 106 containing the linear alternator 10. A series of bolts 108 pass through corresponding holes 110 and 112 in a peripheral flange 114 of the base member 56 and a peripheral flange 116 on the body member 106 to secure the body 106 to the base 56. The body member 106 includes an axial bore 118 having formed on its lower end an internally projecting annular step 120. A tubular linear alternator stator 122 (shown only as a hollow cylindrical shape without details) having a hollow axial passage 121 is disposed within the bore 118 and rests on the shoulder formed by the step 120. The stator 122 is cooled by a liquid coolant, such as water or liquid Freon, circulating in cooling passages 123 formed in the body member 106.

A collar 124 having an axial passage 125 equal in diameter to the passage 121 is threaded into a threaded recess 126 formed at the top of the bore 118 and holds the stator 122 in place. The inner diameter of the step 120 and the axial passage 125 collar 124 are machined precisely and coated with a hard, durable, low-friction coating such as chrome oxide to provide a clearance of about 0.0005 inches with the corresponding matching surfaces of the armature 22 which are provided by a pair of circumferential bands 128 about 0.50 inches wide axially at the top and bottom axial ends of the armature 22. The linear alternator 10 is of the same general variety disclosed in U.S. Pat. No. 4,067,667 and also in U.S. Pat. No. 3,891,874, the disclosures of both of which patents are incorporated herein by reference. Alternatively, the alternator disclosed in allowed U.S. patent application Ser. No. 148,040 for "Linear Oscillating Electric Machine with Permanent Magnet Excitation" filed on May 7, 1980, may be used.

The top and bottom faces of the body member 106 flare outwardly from the collar 124 and the step 120 to provide a pair of hydraulic chambers 130 and 132 at the top and bottom, respectively, of the body member 106. A pair of annular, axially facing grooves 131 and 133 are machined into the top and bottom faces, respectively, of the body member 106 to receive O-rings for sealing the chambers 130 and 132 against leakage of hydralic fluid.

Figure 3:
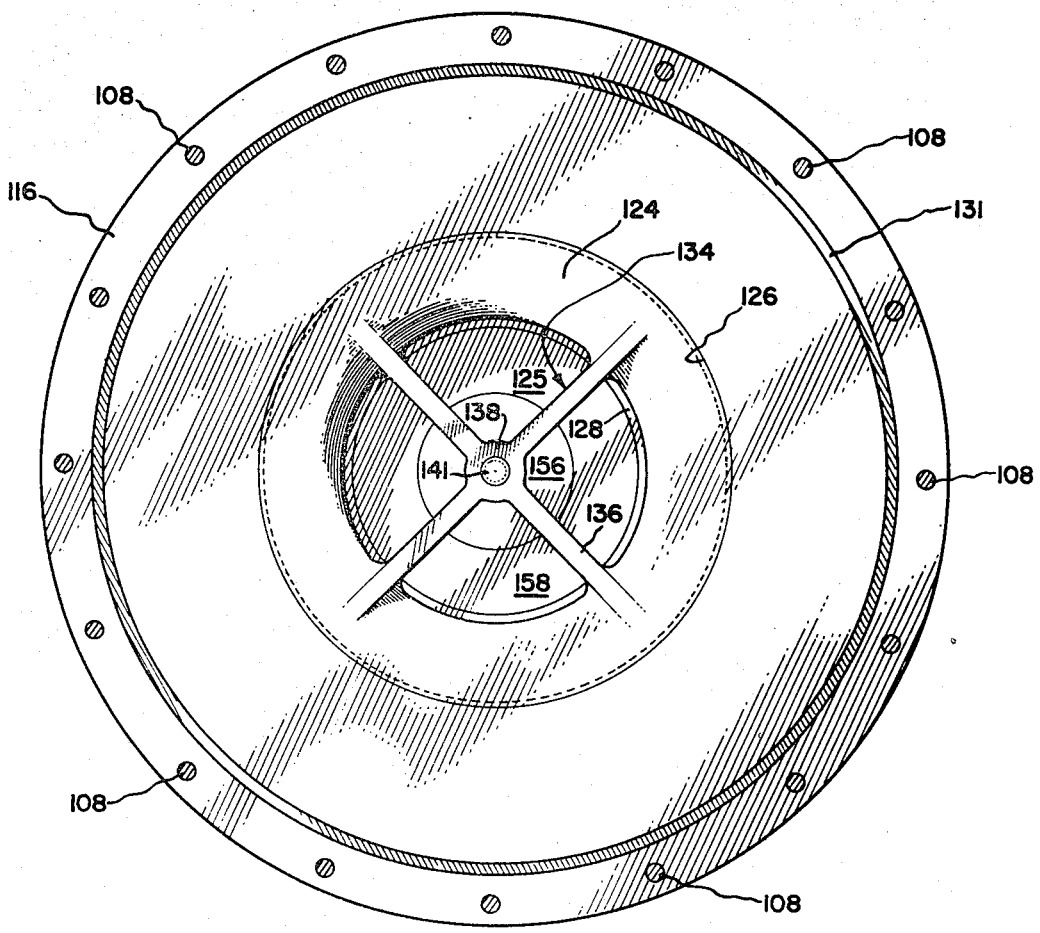
FIG. 3 is a sectional elevation along lines 3—3 in FIG. 1.

Referring now to FIG. 3, the threaded collar 124 carries a spider 134 including a set of radially extending struts 136 terminating in an internally threaded ring 138. A post 140 having a necked down, threaded top stud 141 (best shown in FIG. 1) is threaded into the threaded hole in the ring 138 and extends downwardly approximately half way into the hollow armature 22, terminating in an outwardly extending radial flange 142. The hollow center of the armature 22 is in the form of a cylindrical axial well 144 having a floor 146. The lower spring 148 of a pair of centering springs is biased between the floor 146 of the well 144 and the flange 142 on the post 140 to exert a downward force on the armature when the armature is displaced upward beyond its center position. A porting sleeve 150 is disposed with a sliding fit in the cylindrical well 144 and includes a centrally disposed, inwardly extending radial flange 152 resting against the top surface of the flange 142. The top spring 154 of the centering spring pair is compressed between the top surface of the flange 152 and the undersurface of an inwardly extending flange 156 at the top of the armature well 144. The top centering spring 154 holds the sleeve 150 in place against the flange 142 and coacts with the bottom centering spring to provide a centering force for the armature 22.

Deflection of the engine diaphragm 16 produces a displacement of hydraulic fluid in the hydraulic chamber 130 which acts on the top face 158 of the armature 22. This hydraulic pressure drives the armature downward relative to the stationary stator 122, producing electrical power and storing kinetic energy in the armature 22. The downward motion of the armature causes the bottom face 160 of the armature to displace hydraulic fluid in the hydraulic chamber 132 and cause a downward deflection of the compressor diaphragm 18, which compresses Freon refrigerant R-22 in the compressor, to be described more fully below. As the armature moves upwardly and downwardly on the post 140, hydraulic fluid in the well 144 is displaced and for this purpose a series of openings 162 is formed in the post 140 to permit fluid to flow freely between the well 144 and the hydraulic chamber 130.

Figure 4:
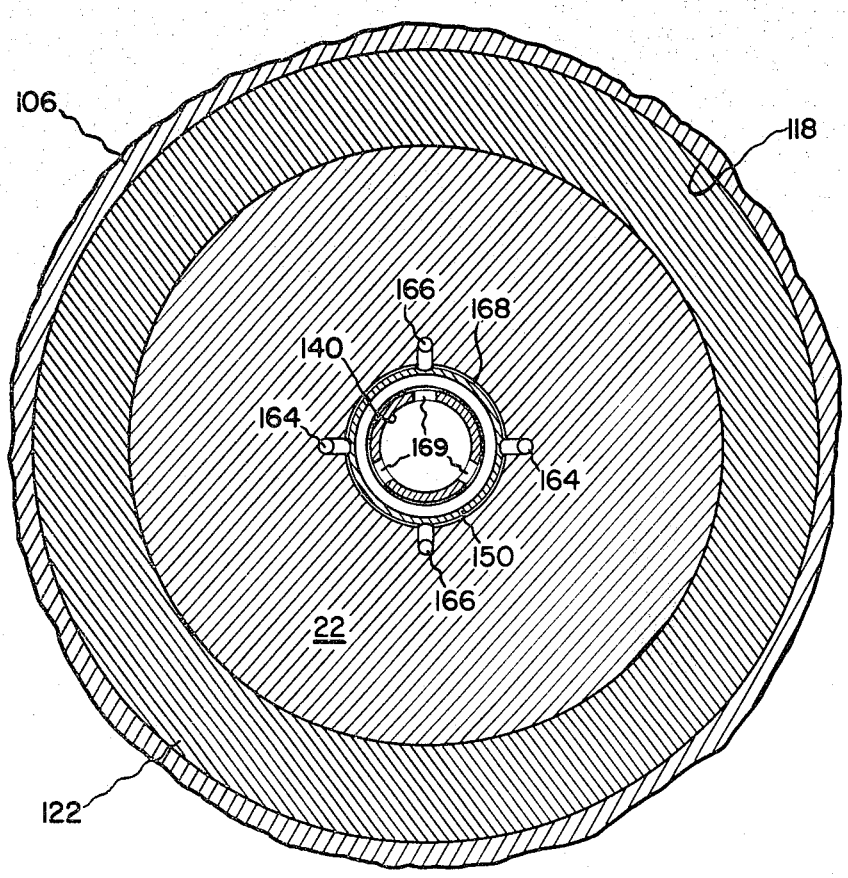
FIG. 4 is a sectional elevation along lines 4—4 in FIG. 1.
Figure 7:
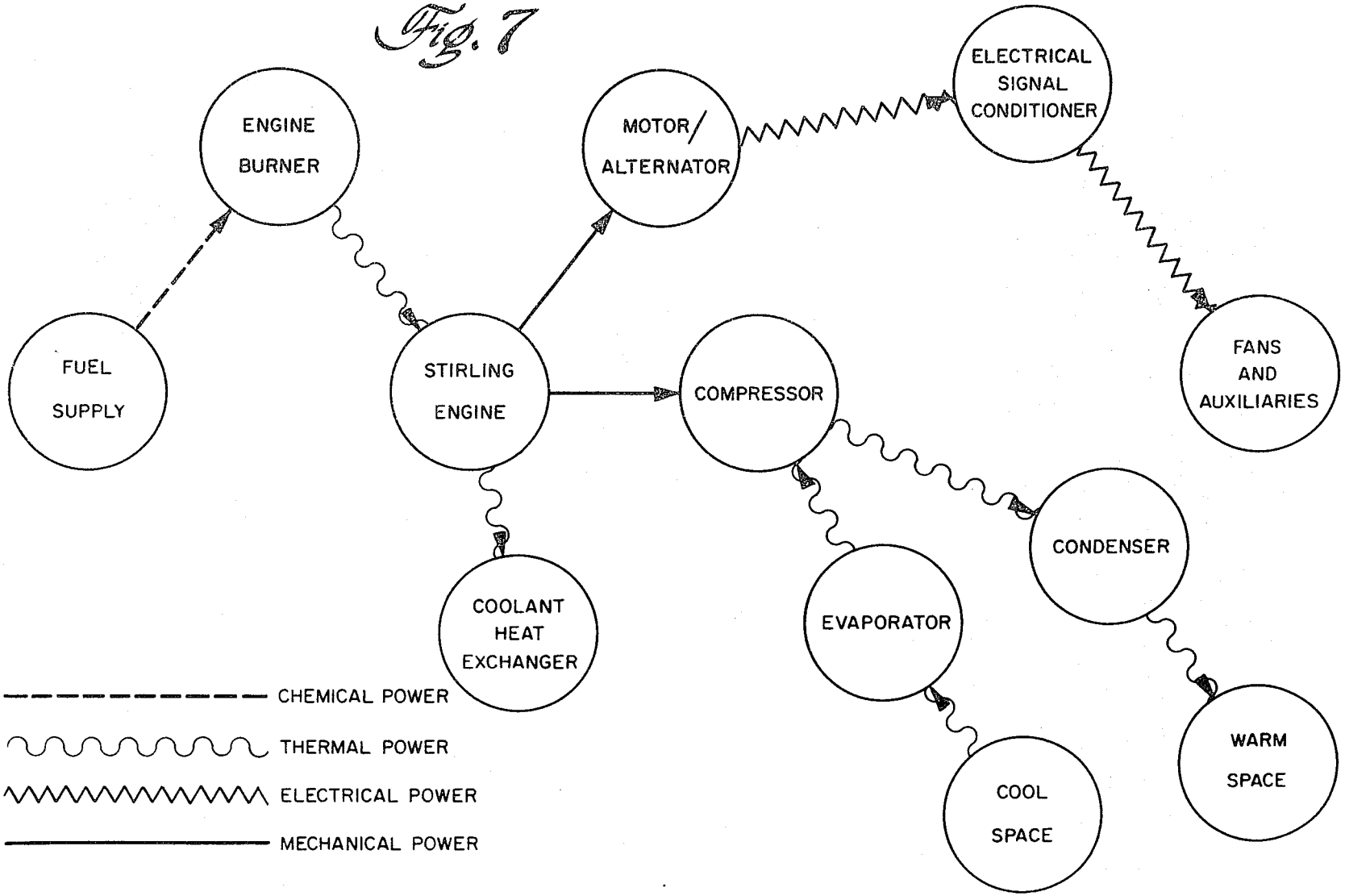
FIG. 7 is a schematic system diagram incorporating the device shown in FIG. 1.

To assure that the mean hydraulic pressures in the two chambers 130 and 132 are equal, a midstroke porting arrangement is provided to equalize the pressure between two chambers at the midstroke position. As shown in FIGS. 1 and 4, the midstroke porting system includes two holes 164 drilled into the bottom face of the armature 22 and opening radially inward at the horizontal plane axially bisecting the armature 22. A second pair of holes 166 is drilled from the top surface 158 of the armature 22 extending downward to the same midplane and opening in the wall of the well 144 at angular spaced positions from the openings of the holes 164. A groove 168 is formed in the porting sleeve 150 for the purpose of establishing communication between the inner ends of the holes 164 and 166 at the midstroke position of the armature 22 to permit hydraulic oil to flow between the top and bottom hydraulic chambers 130 and 132 to equalize the hydraulic pressure between the two chambers at the midstroke position of the armature 22. At positions of the armature 22 other than midstroke, the inner openings of the holes 164 and 166 are not aligned with the groove 168 in the porting sleeve 150 and therefore communication between the holes is sealed by the outer surface of the sleeve 150. An opening 169 is formed in the post 140 to permit oil in the space between the post 140 and the adjacent wall of the well 144, displaced by downward motion of the armature, to flow into the hollow center of the post and then outwardly through the top opening 138 into the top hydraulic chamber 130.

In situations wherein it is desired to maintain a greater mean pressure in the compression space than in the engine space, the desired proportional pressure differential in the two hydraulic chambers at piston midstroke may be maintained by locating position of the porting connection between the hydraulic chambers 130 and 132 beyond midstroke toward the upper hydraulic chamber 130 so that, at the stroke position when communication is established between the two chambers, the hydraulic pressures in the two chambers is equal. The midstroke force balance on the piston is achieved by a stiffer lower balancing spring 148.

The sleeve 150 is made as a separate piece from the post 140 for ease of manufacture. The post 140 could be sized to provide the sliding surfaces, ports and groove of the sleeve 150, but such an arrangement would require that the post 140 be supported concentrically with the armature well 144 and the openings 120 and 125 at the top and bottom of the stator, or that the post 140 be provided with a floating connection at its fixed end. The separate sleeve 150 provides that floating function without structural complexity or fatigue prone connections, and makes it a simple manufacturing job to machine the armature and sleeve to provide the separate independent concentricities between the armature and stator, and between the armature well and sleeve 150 militates for low production cost with high-precision matching surfaces without misalignment problems and their attendant high wear rates and low life.

The bottom portion of the hermetic vessel is in the form of a compressor base 170 for the compressor 14, attached to the body member 106 by bolts 172 extending through holes 174 and 176 in flanges 178 and 180 formed respectively on the body 106 and the compressor base 170. The top face of the compressor base 170 is dished downward slightly to provide a concave surface 182 to receive but limit the deflection of the compressor diaphragm 18. The compressor diaphragm itself is welded at 183 around its outer periphery to the top face of the compressor base 170.

A series of gas intake valves 184 (only one of which is shown) are disposed around the compressor base 170 communicating with a suction plenum 186 containing a refrigerant such as Freon R-22 at suction pressure. The valves 184 themselves are of the conventional reed type having a reed 188 lying on an apertured support permitting fluid flow in the inward direction but shuttling the fluid communication through the apertures in the apertured support 190 and preventing fluid flow backward into the suction plenum 186. A backing plate 192 is fastened to the compressor base to prevent excessive deflection of the reed 188.

A series of discharge valves 194 (only one of which is shown) of design corresponding to the suction valves 184 but permitting fluid flow in an outward direction into a discharge plenum 196 but not in the other direction is disposed around the compressor base 170 in a ring concentric with the outer ring on which the suction valves 184 are located.

It is desirable to maintain the mean pressure of the working fluid in the engine 12 equal or proportional to the mean pressure in the compression space 198 between the lower face of the compressor diaphragm 18 and the dish-shaped upper face 182 of the compressor base 170 so that the mean positions of the diaphragms 16 and 18 are flat and the mean position of the piston 21 is centered. Moreover, it ensures that the engine and power section dynamics remain concordant over the full operating mean pressure range of the compressor, and that the available engine power, which is a function of the engine working gas pressure, increases as the compressor mean pressure (and hence the compressor power demand) increases.

To maintain the mean pressure of the working space of the engine 12 and the compression chamber of the compressor 14 equal, a pressure control system 200 is provided to adjust the engine working space pressure to correspond to the pressure of the compression chamber 198. The pressure control system 200 includes a pressure adjustment valve 201 connected to a pressure comparator 202 including a chamber 204 formed in a pressure control body 206. A bellows member 208 is fastened to the floor of the chamber 204 and is in fluid communication with the compression chamber 198 of the compressor 14 by way of a capillary tube 210 which pressurizes the interior of the bellows 208 with the mean pressure of the compression chamber 198 but is of such a fine diameter that the pressure swings above and below the mean pressure are not transmitted through the tube 210 to the bellows 208. A corresponding capillary tube 212 connects the interior of the chamber 204 on the exterior of the bellows 208 to the working space of the engine 12 to pressurize the chamber 204 to the mean pressure of the working space. The pressure adjustment valve 201 includes a spool valve member 214 connected to the top of the bellows 208 and extending through a valve bore in the pressure control body 206. An axial bore is formed through the spool valve member 214 communicating the pressure of the working gas in the chamber 204 to the top of the spool valve member so that the areas on which the engine working gas and the compressor working gas act are equal.

A low-pressure reservoir chamber 216 and a high-pressure reservoir chamber 218 are formed in the body member 206 and are connected to the working space of the engine 12 by a pipe 220, through a passage 221 in the body member 206 which includes an annular bypass 223 around the spool valve member 214, and through a set of check valves 222 and 224. The check valve 222 permits the low-pressure reservoir 216 to discharge whenever the pressure of the working gas in the working space, during its cyclic changes of pressure, falls below the pressure in the low-pressure reservoir. The check valve 224 permits working gas to enter the high-pressure reservoir 218 whenever the pressure of the working gas in the working space of the engine 12 exceeds the pressure in the high-pressure reservoir. In this way, the low-pressure and high-pressure reservoirs 216 and 218 are maintained at about the minimum and maximum pressures, respectively, of the working space of the engine 12.

The spool valve member 214 moves up or down in response to the pressure differential between the mean gas pressure in the engine working space and in the compression chamber 198. When the pressure in the working space is higher than the pressure in the compression chamber 198 the bellows 208 collapses and draws the spool valve member 214 downwardly. This establishes fluid communication between the working space of the engine 12 and the low-pressure reservoir by way of the pipe 220, the passage 221 in the body 206, an annular relief in the spool valve member 214, and a connecting pipe 226 which bypasses the check valve 222. Working gas is then permitted to flow from the working space into the low-pressure reservoir until the mean pressure of the working fluid in the working space drops to the mean pressure of the compression chamber 198 and the spool valve member 214 returns to its central position.

If the mean pressure of the working space fluid in the engine 12 is less than the mean pressure of the fluid in the compression chamber 198, the bellows 208 expands upwardly establishing fluid flow communication between the engine and the high-pressure reservoir by way of the pipe 220, the passage 221, a lower annular relief in the spool valve member 214, and a second bypass pipe 228 which bypasses the check valve 224. This permits working fluid to flow from the high-pressure reservoir through the bypass pipe 228 and the pipe 220 into the working space of the engine 12 until the mean pressure of the working space gas rises to the mean pressure of the compression chamber, at which time the pressures in the chambers 204 and 208 will be equal and the spool valve will return to its center position.

The modification mentioned previously for operating the system with the mean pressure in one of the engine or compressor working gas, greater than the other, wherein the spring 154 or 148 is replaced with a heavier spring or supplemented with another spring to balance the greater pressure exerted by the higher pressure working gas, the midstroke hydraulic balancing ports 164 and 166 and the groove 168 in the sleeve 150 are moved downwardly or upwardly to a position where the hydraulic pressure balances, also requires a suitable compensation spring to be added to the control chamber 204 to supplement the pressure force of the higher pressure gas on the bellows 208.

The installation of a heat pump system powered by the disclosed power unit is nearly identical to the installation of a conventional system, so it can be done by service technicians without any special training. The power unit is delivered already fully charged with engine working gas in the engine working space, hydraulic fluid in the hydraulic chambers 130 and 132, and refrigerant in the compressor space 198. The engine working gas charge is made through a pressure valve/fitting 230 and the compressor refrigerant charge is made through a pressure valve/fitting 232. These fittings may also be used during routine maintenance to renew the charges, as may be required. The hydraulic chambers 130 and 132 are evacuated through a vacuum fitting (not shown) and are charged with hydraulic fluid through an oil fitting 233. The high-pressure reservoir is charged with engine working gas through a gas fitting 234. These fittings are convenient for high volume production of Stirling engine power units for heat pumps and preparation for installation, and also for system checks to ensure that the pressures in the several chambers are according to specifications, for analysis and debugging, and for correction of problems.

The dynamics and thermodynamics of the system will now be described with reference to FIGS. 5 and 6. The basic thermodynamics of the diaphragm Stirling engine is similar to the conventional Stirling engine: the working space defined by the heater head 46 and the engine diaphragm 16 is filled with a working gas having low viscosity and high heat capacity such as helium or hydrogen. The engine is heated at its top end by the heater 20 and is cooled at its lower end by the cooler formed by the cooling passages 94 in the base member 56. The motion of the displacer 58 and the power piston 21 (which hydraulically drives and is driven by the engine diaphragm 16 and therefore moves in phase with it) causes the working gas to be compressed when most of the gas is cold, and to be expanded when most of the gas is hot.

As shown in FIG. 5, the motion $X_p$ of the engine diaphragm 16 (driven by the power piston 21) results in a pressure component $P_p$ that is nearly in phase with the motion of the diaphragm 16. The motion $X_D$ of the displacer 58 results in a pressure wave that is a combination of an in-phase component due to the volume change in the working space caused by the upward flexing of the outside edges of the displacer diaphragm 86 causing an effective increase in the displacer volume, and a 180° out-of-phase thermal component due to the heating and cooling of working gas being shuttled from the hot space to the cold space. The thermal component is much stronger than the displacer effective volume increase component. The displacer pressure component $P_D$ when added to the engine diaphragm pressure component $P_p$ results in a composite pressure wave $P_c$ which lags the engine diaphragm displacement by approximately 30°. Thus the thermodynamic system converts heat to a pressure wave in the engine working gas which delivers power to both the engine diaphragm for power output and to the displacer to maintain displacer reciprocation. The power output from the Stirling engine is in the form of a small deflection of the engine diaphragm 16 which produces a volumetric displacement of the hydraulic fluid in contact with the lower side of the engine diaphragm 16.

The fluid friction of the gas shuttling between the hot and cold spaces is the damping load on the displacer that must be overcome by power input from the engine. The pumping power required to overcome this fluid friction loss and maintain the displacer 58 in motion is supplied by the thermodynamic cycle by means of the cycle pressure acting on the area differential $A_r$ between the top surface of the displacer 58 and the bottom surface of the displacer diaphragm 86. The driving force of the working gas on the displacer 58 is equal to the expansion space pressure $P_e$ multiplied by the displacer area differential $A_r$. This displacer drive pressure force is identified as 98 on the phasor diagram of FIG. 5. The damping load of the pressure drop of the working gas through the heat exchangers is equal to the next pressure drop $\Delta P$ acting on the unblanketed area of the displacer or $\Delta P(A-A_r)$, shown at 100 in the phasor diagram of FIG. 5. The spring force of the displacer diaphragm acting on the displacer is shown at 102 and the displacer inertia force 104 completes the force diagram.

The displacer diaphragm gives a much shorter stroke or a much stiffer spring constant than a corresponding gas spring. This design also permits a much heavier displacer, approximately 10 times the displacer mass for a corresponding gas spring design, so the manufacturing limitations are much relaxed. Indeed, supplemental masses in the form of ceramic discs 76 and 78 are added to the displacer to increase its mass and inhibit heat transfer. By eliminating the gas spring from the corresponding gas spring design, the damping component contributed by the hysteresis losses in the gas volume is eliminated and therefore the power required to drive the displacer will be less than for a corresponding gas spring design.

The engine diaphragm 16 and the compressor diaphragm 18 function primarily to allow the transmission of engine power while hermetically separating the working fluids. In theory, this sealing function could be performed by a single diaphragm, but we have determined that this is not practically feasible. The reason is that both the engine and the compressor act as springs, that is, in addition to their power output and power absorption, they also possess significant spring force components which are 180° out-of-phase with their displacements. Dynamically, these spring components must be offset by properly sized mass components, and for this purpose the small mass of a single thin diaphragm would be inadequate. Fortunately, at constant power the dynamic effect of a given mass increases as the square of the stroke. By using two diaphragms with fluid communication, effective stroke multiplication is achieved simply by reducing the frontal area of the interconnecting fluid duct. By appropriate choice of duct dimensions, the mass effect could be provided solely by the motion of the oil, but in this design the mass effect is achieved by placing a plunger within a somewhat larger duct diameter. The plunger mass conveniently and synergistically becomes the alternator armature.

There are two major losses associated with the motion of the alternator plunger in the fluid duct: sheer loss between the moving plunger and the wall, and leakage loss past the plunger. For a given diametrical clearance and fluid viscosity, the former tends to increase and the latter to decrease with increasing active clearance length. Hence there is an optimum clearance length in a corresponding minimum dissipation at which the two loss mechanisms are balanced. We have discovered that for normal hydraulic fluid viscosities and a diametrical clearance of 0.0005 inches, the optimum active length of the clearance band is approximately 1.00 inches. This clearance length is provided by two clearance bands 128, one at each end of the plunger, each 0.50 inches long. The corresponding maximum power dissipation is approximately 40 watts, or only about 1% of the output power of the system.

The force phasor balance diagram of FIG. 6 for the engine diaphragm 16, the alternator armature 22 and the compressor diaphragm 18 includes an in-phase inertia and an out-of-phase spring force component for the engine diaphragm. The out-of-phase spring component dominates because the engine diaphragm's natural frequency is designed above the operating frequency. The resultant diaphragm force and the engine pressure force on the diaphragm is transmitted to the top face 158 of the alternator armature 22. The electromagnetic interaction of the alternator armature 22 with the stator 122 results in a damping force on the armature lagging the motion of the engine diaphragm 16 by about 90° (actually slightly more than 90° due to the inductive nature of the alternator). As mentioned previously, the other function of the alternator armature is to provide a dynamic energy inertia storage between the engine and compressor. The compressor diaphragm 18 has the same characteristics as the engine diaphragm 16. The compressor pressure acting on the compressor diaphragm results in a load force that produces both a spring component and a damping component. The compressor diaphragm will have significantly higher harmonics that will be reflected in the force on the armature 22, however the armature mass is large enough to hold the higher harmonics of this motion to a small amplitude.

The dynamic force balances and thermodynamics described above demonstrate the stable periodic operation of this system. The displacer stroke/diameter ratio and phase angle are stable within the range of conditions encountered with this system, and the characteristics of the engine power versus stroke of the engine and compressor produces a compressor load increasing faster than the engine stroke so that the system is stable, that is, if perturbed the engine will return to its nominal operating point, and the system will follow the engine characteristics as the operating point is changed. For example, in a hypothetical situation, assume the compressor output were reduced. If this were a constant stroke machine, the appropriate control action would be to increase the clearance volume, which would in turn reduce the Freon flow. In this case, the interaction with the engine would actually result in a higher compressor output. Therefore, the appropriate control action would be to decrease the clearance volume because the heater control would not respond immediately and the system would follow the constant heat flux curve in reducing stroke. As the stroke dropped, the heater temperature would increase. The heater control would then reduce heat input to maintain heater temperature and the whole system would then settle down to a new operating point.

The use of balanced fluid pressures in the compressor and in the engine enable the use of walls in the Stirling engine which are much thinner than the walls in conventional Stirling engines. Although the power output is somewhat lower and could be achieved with higher pressures, the savings in reduced heat losses over those which would be experienced with thick high pressure resistant walls makes this design more efficient than it would be with higher operating pressures. The cost of manufacturing a low-pressure heater head 46 as opposed to a high-pressure heater head also offers significant economics. The low-pressure engine and the use of helium rather than the conventional hydrogen make it possible to achieve perfect safety very effectively and inexpensively, as contrasted with certain high-pressure hydrogen Stirling engines.

The use of the displacer diaphragm eliminates the wear and losses found in conventional displacer control systems. This system partakes of all the advantages of a free-piston Stirling engine, that is where the displacer is mechanically unconnected from the power output member, but suffers from none of its disadvantages such as phasing control, power transmission between the displacer and the power piston, hysteresis losses in the gas spring and frictional losses in the displacer rod. However, this design permits hermetic sealing of the entire unit which virtually eliminates the problem of working fluid or hydraulic fluid leakage from the unit. With the use of helium as a working fluid instead of hydrogen, the loss of working fluid is all but eliminated producing a maintenance interval estimated at 15 years. Without lubrication in the engine, there is no problem whatsoever of maintaining lubrication, preventing contamination of the regenerator by lubricants, viscous losses in the lubricant, and the many other attendant disadvantages of oil lubrication. The result is a low-cost, low-maintenance, efficient, reliable, quiet and dependable machine which should find immediate and long-term acceptance by the purchasing public.

Obviously, numerous modifications and variations of this disclosed embodiment are possible in light of this disclosure. This is a basic invention and can be embodied in a wide range of Stirling engine designs and applications for the Stirling engine. Accordingly, it is to be expressly understood that the many modifications and variations and all applications thereof, and all the equivalents of the above are to be considered to fall within the spirit and scope of the invention as defined in the following claims, wherein,

I claim:

1. A gaseous fuel combustor for a Stirling engine, comprising:

a shell having lower portions adapted to engage a Stirling engine heater head;

air inlet and exhaust ports formed in said shell;

a heat recuperator having inlet and exhaust channels opening at one end communicating with said inlet and exhaust ports;

an annular burner disposed in said shell lower portions and having gas flame apertures facing radially inwardly at the radial extremities of said heater head and communicating with the inlet channel at the other end of said heat recuperator;

a dome-shaped, centrally apertured partition closely spaced from said heater head and forming therewith a first dome-shaped gap;

a dome-shaped insulating cap disposed over said partition and forming therewith a second dome-shaped gap communicating with the first dome-shaped gap through said central aperture of said first dome partition, and with the exhaust channels of said other end of said heat recuperator.

2. The combustor defined in claim 1, wherein said heater head is externally finned.

3. The combustor defined in claim 1, further comprising an annulus of insulation surrounding said shell.

4. The combustor defined in claim 1, wherein said annular burner includes an annular pipe disposed within an annular conduit of tear-shaped conduit directed radially inwardly and forming said gas flame apertures.

5. The combustor defined in claim 1, wherein said recuperator is formed of multiple volute partitions in an annular flow channel dividing said flow channel into a multiplicity of axially extending channels of equal width and length and equal surface area for optimum heat exchange between said exhaust gas and said inlet air.

6. The combustor defined in claim 1, wherein said dome-shaped partition is formed of a cast heat resistant ceramic material.

7. The combustor defined in claim 1, further comprising a funnel-shaped partition overlying said cap and forming therewith an exhaust gap communicating between said exhaust port and said exhaust channels of said heat recuperator one end, said funnel-shaped partition forming with the top of said shell a suction gap communicating between said inlet port and said inlet channels of said one end of said recuperator for preliminary heat exchange between said inlet and said exhaust before said recuperator.

8. The combustor defined in claim 7, wherein said funnel-shaped partition and said exhaust port are formed as one piece having a central, tubular extension which forms said exhaust port and extends through and is fastened to the peripheral edges of a circular opening in the top of said shell.

9. The combustor defined in claim 1, wherein said exhaust port is at the top center of said shell and discharges upwardly away from said engine thereby preventing unwanted heat exchange between the engine cooler and exhaust gases from said combustor.

10. The combustor defined in claim 1, wherein said recuperator is formed of multiple volute partitions in an annular flow channel dividing said flow channel into a multiplicity of axially extending channels of equal width and length and equal surface area for optimum heat exchange between said exhaust gas and said inlet air; and further comprising a funnel-shaped partition overlying said cap and forming therewith an exhaust gap communicating between said exhaust port and said exhaust channels of said heat recuperator one end, said funnel-shaped partition forming with the top of said shell a suction gap communicating between said inlet port and said inlet channels of said one end of said recuperator for preliminary heat exchange between said inlet and said exhaust before said recuperator.

* * * * *